US006431893B1

(12) United States Patent
Chang et al.

(10) Patent No.: US 6,431,893 B1
(45) Date of Patent: Aug. 13, 2002

(54) SWITCH FOR AN ELECTRICAL CARD CONNECTOR

(75) Inventors: Jen Jou Chang, Yung-Ho; Hugh Chi Hsu, Tu-Chen, both of (TW)

(73) Assignee: Hon Hai Precision Ind. Oc., Ltd., Taipei Hsien (TW)

( * ) Notice: Subject to any disclaimer, the term of this patent is extended or adjusted under 35 U.S.C. 154(b) by 0 days.

(21) Appl. No.: 09/876,770

(22) Filed: Jun. 6, 2001

(30) Foreign Application Priority Data

Mar. 20, 2001 (TW) ..... 90204164 U

(51) Int. Cl.[7] ..... H01R 29/00
(52) U.S. Cl. ..... 439/188; 439/489
(58) Field of Search ..... 439/489, 188, 439/630

(56) References Cited

U.S. PATENT DOCUMENTS 6,039,599 A * 3/2000 Benjamin et al. ..... 439/489
6,045,049 A * 4/2000 Nishimura et al. ..... 439/489
6,086,426 A * 7/2000 Chang ..... 439/188
6,099,335 A * 8/2000 Chang ..... 439/188
6,120,310 A * 9/2000 Chang ..... 439/188
6,126,464 A * 10/2000 Chang ..... 439/188
6,129,570 A * 10/2000 Griffin et al. ..... 439/188
6,132,229 A * 10/2000 Wu ..... 439/188
6,135,809 A * 10/2000 Asakawa ..... 439/489
6,159,051 A * 12/2000 Chang ..... 439/188
6,231,395 B1 * 5/2001 Odic ..... 439/489
6,267,619 B1 * 7/2001 Nishioka ..... 439/489

* cited by examiner

*Primary Examiner*—Gary F. Paumen
(74) *Attorney, Agent, or Firm*—Wei Te Chung

(57) ABSTRACT

An electrical card connector (1) includes an insulative housing (2), a plurality of electrical terminal (3) received in the housing, an end position switch (4) and a protection-detecting switch (5). The protection-detecting switch is used for detecting if an inserting electrical card is in a write-protect state and is insert molded in the housing. The protection-detecting switch includes an actuating contact (51) and a fixed contact (52). The actuating contact comprises a cantilever (514). The fixed contact comprises a fixing panel (521) and a resilient contact portion (522). The cantilever is downwardly moveable by the electrical card to engagingly push outwardly the resilient contact portion of the fixed contact.

1 Claim, 4 Drawing Sheets

SWITCH FOR AN ELECTRICAL CARD CONNECTOR

FIELD OF THE INVENTION

The present invention relates to an electrical card connector, and particularly to an electrical card connector which has a detecting switch for detecting write-protect of an inserted electrical card.

BACKGROUND OF THE INVENTION

Electrical card connectors are mounted on printed circuit boards and electrically interconnect an electronic card received therein with the printed circuit board.

A conventional electrical card connector usually includes a switch for the purpose of detecting the presence or writ-protect of an electrical card, as is disclosed in U.S. Pat. No. 5,188,986. In this patent, referring to FIG. 4, an electrical card connector has a housing 70 and a switch 60 for detecting the presence of an electrical card 14 within the housing 70. The housing 70 defines a slot 40 in an outer side of a sidewall thereof. A channel 41 extends into the slot 40 from an inner side of the sidewall. The switch 60 includes a moveable contact 62 and a fixed contact 64. The moveable contact 62 has a generally U-shaped retaining portion 62*b* and a spring arm 62*d* extending from the retaining portion 62*b* . The U-shaped retaining portion 62*b* is received in a corresponding groove 66 within the sidewall of the housing 70 to hold the moveable contact 62 within the housing 70. A distal end 62*a* of the spring arm 62*d* extends into the slot 40. The fixed contact 64 is received in the slot 40 for contacting the moveable contact 62. In use, the movement of the card 14 causes the moveable contact 62 to contact the fixed contact 64.

The electrical card connector is required to meet more challenging requirements in accordance with the trend toward lighter, thinner, shorter, and smaller electronic devices in the electronic field. The thickness of the sidewall of the conventional electrical card connector cannot be further reduced. Otherwise, the movement of the moveable contact 62 would be difficult.

Additionally, the contacts 62, 64 of the switch 60 of the conventional electrical card connector is entirely supported by the sidewall of the housing 70 of the connector. Reducing the thickness of the sidewall, due to a large required push normal force from the contacts 62, 64 of the switch 60, the sidewall of the housing 70 tends to yield or becomes damaged after a period of use.

Therefore, an improved electrical card connector is desired to overcome the disadvantages of the prior art.

BRIEF SUMMARY OF THE INVENTION

A main object of the present invention is to provide an electrical card connector having switch which has a reduced thickness of a sidewall of a housing.

Another object of the present invention is to provide an electrical card connector having a switch which avoids distortion of the housing and strengthens the strength of the housing.

An electrical card connector in accordance with the present invention comprises an insulative housing, a plurality of signal contacts received in the housing, an end position switch and a protection-detecting switch for detecting an electrical card as it is in a write-protect state. The housing includes a base portion and a sidewall upwardly extending from a side of the base portion. The sidewall defines a cutout therethrough for locating the protection-detecting switch.

The protection-detecting switch includes an actuating contact and a fixed contact. The actuating contact includes a cantilever. The fixed contact includes a fixing panel. A resilient contact portion extends from the fixing panel for engaging with the cantilever of the actuating contact. When the inserted electrical card is in a write-protect state, the cantilever of the actuating contact is pressed downwardly to engagingly push outwardly the resilient contact portion of the fixed contact.

The protection-detecting switch is insert molded in the sidewall and the base portion of the housing. Thus, force exerted on the protection-detecting switch is not only supported by the sidewall of the housing, but also by the base portion of the housing. The fixing panel longitudinally extends across the cutout for strengthening the strength of the housing. The protection-detecting switch is located in the cutout of the housing. Therefore, the housing need not any groove or channel for receiving the protection-detecting switch. The thickness of the sidewall of the housing is therefore reduced.

Other objects, advantages and novel features of the invention will become more apparent from the following detailed description when taken in conjunction with the accompanying drawings.

DETAILED DESCRIPTION OF THE INVENTION

Figure 1:
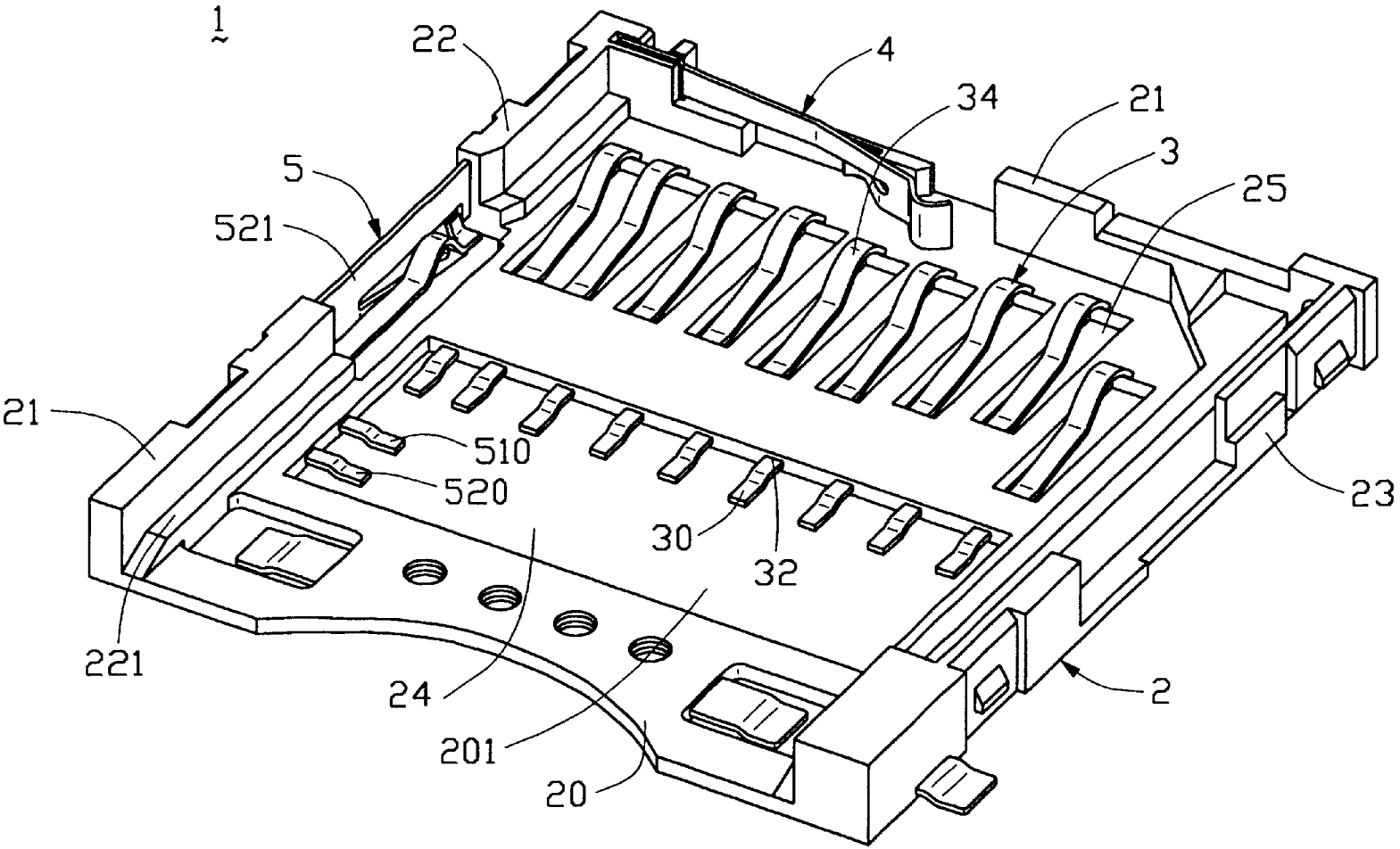
FIG. 1 is an assembled view of an electrical card connector in accordance with the present invention.

Referring to FIG. 1, an electrical card connector 1 comprises an insulative housing 2, a plurality of electrical terminal 3, an end position switch 4 and a protection-detecting switch 5.

The housing 2 comprises a substantially rectangular base portion 20, a rear wall 21, and first and second parallel sidewalls 22, 23. The rear wall 21 extends upwardly from a rear side of the base potion 20. The sidewalls 22 and 23 extend upwardly from two opposite sides of the base portion 20. Thus, a card receiving space 24 is defined by the rear wall 21, the first sidewall 22 and the second sidewall 23 of the housing 2 for receiving an electrical card (not shown).

A plurality of terminal passageways 25 are defined in the base portion 20 and parallel to the first and second sidewalls 22, 23. A substantially rectangular hollow portion 201 is defined in the base portion 20.

A stepped portion 221 is disposed in an inner surface of each sidewall 22 and 23 for supporting the inserted electrical card. A cutout 26 is defined through the first sidewall 22 and extends into the base portion 20 for receiving the protection-detecting switch 5.

The electrical terminals 3 are resilient and each defines a mounting end 30, a curved contacting end 34 and a fixing portion 32 between the mounting and the contacting ends 30, 34.

The end position switch 4 is mounted in the rearwall 21 of the housing 2 for detecting the inserted card as it reaches a fully inserted position in the connector 1.

Figure 2:
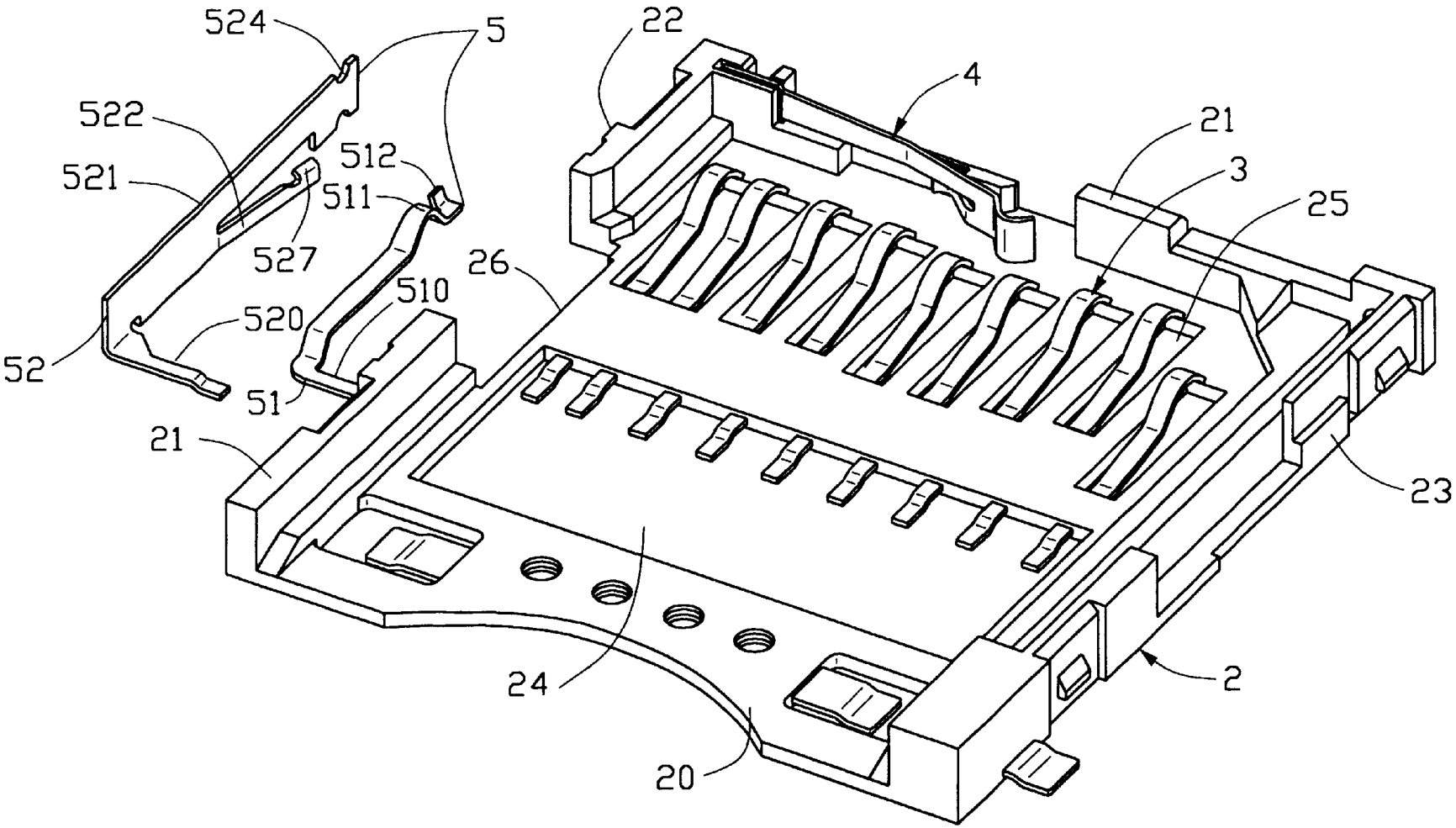
FIG. 2 is a perspective view of a protection-detecting switch and a housing of the electrical card connector.
Figure 3:
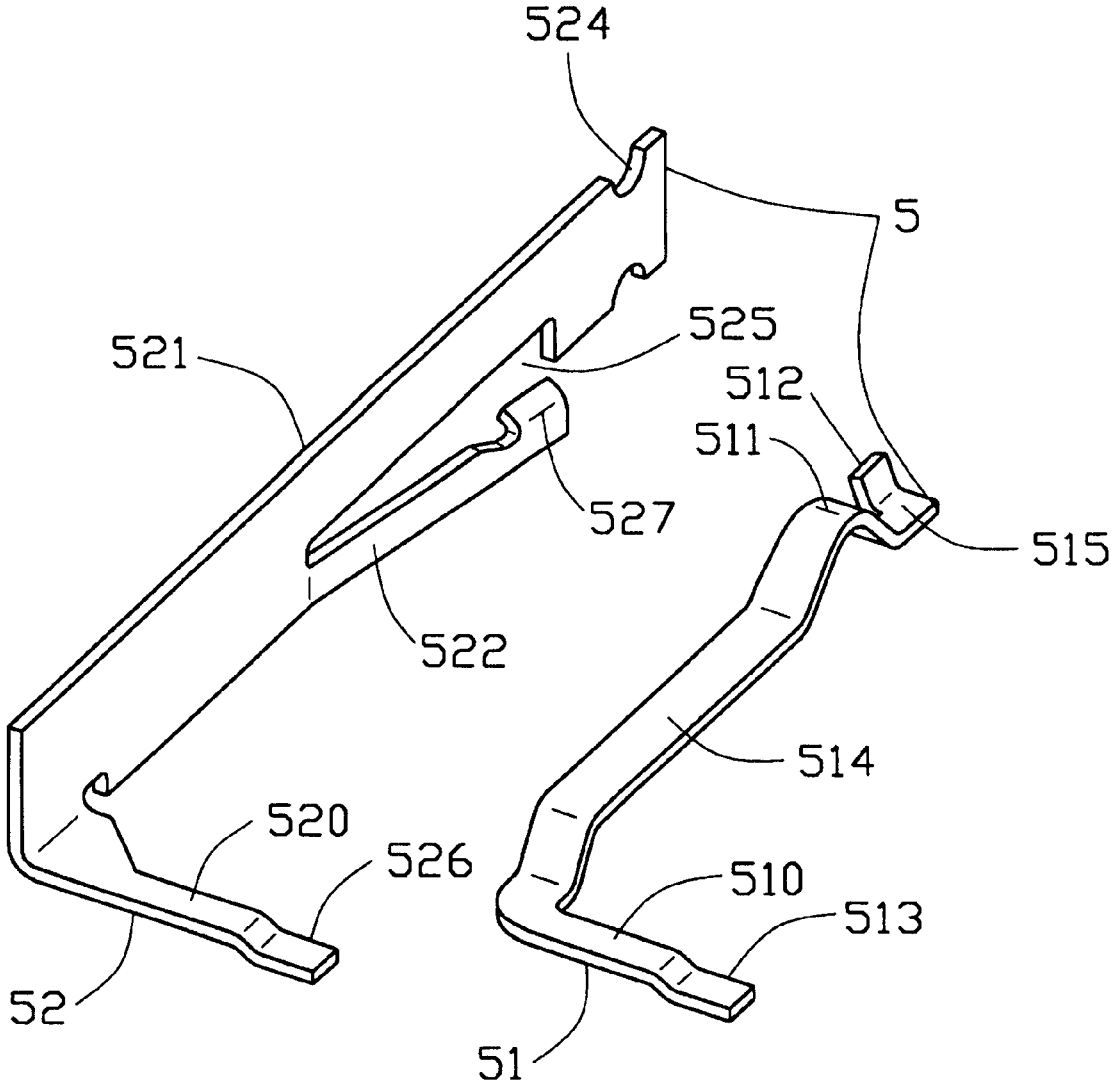
FIG. 3 is a perspective view of the protection-detecting switch in accordance with the present invention.
Figure 4:
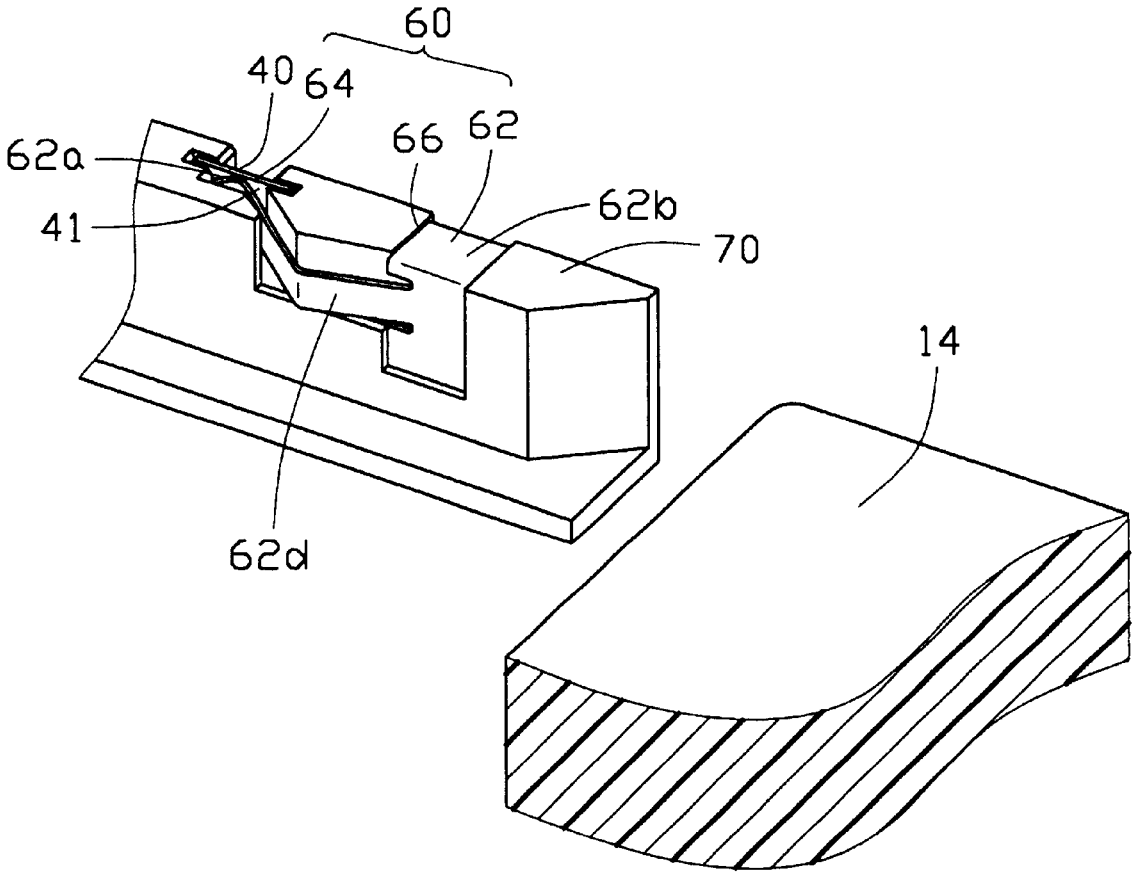
FIG. 4 (PRIOR ART)
FIG. 4 is a conventional switch assembled with an electrical card connector.

Referring to FIGS. 2–3, the protection-detecting switch 5 is insert molded in the first sidewall 22 and the base portion 20 of the housing 2 for detecting if the inserted card as it is in a write-protect state. The protection-detecting switch 5 includes an actuating contact 51 and a fixed contact 52.

The actuating contact 51 includes a first tail portion 510 and a cantilever 514. The first tail portion 510 has a first solder portion 513 -on a distal end thereof for soldering to a circuit board (not shown). The cantilever 514 rearwardly extends from an opposite end of the first tail portion 510.

The cantilever 514 includes an arcuate portion 511 upwardly formed on a distal end thereof for contacting a bottom of the inserted electrical card. A linking piece 515 horizontally extends from a distal end of the arcuate portion 511. An actuating piece 512 upwardly and outwardly extends from the linking piece 515 for contactingly actuating the fixed contact 52.

The fixed contact 52 includes a second tail portion 520, a substantially rectangular fixing panel 521 and a resilient contact portion 522. The second tail portion 520 has a second solder portion 526 on a distal end thereof for soldering to the printed circuit board. The fixing panel 521 substantially rearwardly and perpendicularly extends from the second tail portion 520. The fixing panel 521 defines two actuating notches 524 in opposite sides of a free end thereof for securely retaining the fixed contact 52 in the first sidewall 22 of the housing 2. The fixing panel 521 defines a substantially rectangular opening 525 in a lower and substantially middle portion thereof. The contact portion 522 rearwardly and inwardly extends from a front side of the opening 525. A curved portion 527 is formed on a free end of the contact portion 522 for contacting the actuating piece 512 of the actuating contact 51.

In assembly, the electrical terminals 3 are insert molded in the terminal passageways 25 in the base portion 20 with the fixing portion 32 being retained by the base portion 20 and the mounting end 30 extending into the hollow portion 201. The curved contacting ends 34 extend above the upper surface of the base portion 20 where they will engage with pads on inserted electrical card. The end position switch 4 is received in the rear wall 21. The protection-detect switch 5 is insert molded in the first sidewall 22 and the base portion 20. A part of the cantilever 514 of the actuating contact 51 is insert molded in the first sidewall 22, the arcuate portion 511 and the actuating piece 512 exposed in the cutout 26. The fixing panel 521 of the fixed contact 52 is perpendicularly insert molded in the first sidewall 22 and longitudinally extends across the cutout 26 for strengthening the strength of the housing 2. The contact portion 522 exposes to the cutout 26 of the first sidewall 22. The first tail portion 510 of the actuating contact 51 and the second tail portion 520 is insert molded horizontally in a lower portion of the first sidewall 22 and extends into the hollow portion 201 of the base portion 20.

When the inserted electrical card is not in the write-protect state, the curved portion 527 of the fixed contact 52 is not in contact with the actuating piece 512 of the actuating contact 51 and the protection-detecting switch 5 is in a normal position. When the inserting electrical card is in the write-protect state, a part of a bottom of the inserting electronic card presses downwardly the arcuate portion 511 of the actuating contact 51. Then the actuating piece 512 of the actuating contact 51 engagingly pushes outwardly the curved portion 527 of the fixed contact 52, thereby establishing an electrical connection therebetween and providing an electrical signal indicating that the electrical card is in the write-protect state. Thus, the cantilever 514 of the actuating contact 51 moves in vertical direction, and the contact portion 522 moves outwardly.

Force exerted on the switch 5 is not only supported by the first sidewall 22 of the housing 2, but also by the base portion 20 of the housing 2. The strength of the housing 2 is strengthened because the fixing panel 521 longitudinally extends across the cutout 26. The switch 5 is located in the cutout 26 of the housing 2. Therefore, the housing 2 need not any groove or channel for receiving the switch 5. The thickness of the sidewalls 22, 23 of the housing 2 can also be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for connecting an electrical card with a printed circuit board, comprising:

an insulative housing receiving a plurality of signal contacts therein, the housing including a base portion and a sidewall extending from the base portion; and a detecting switch insert molded in the sidewall and the base portion of the housing and comprising an actuating contact and a fixed contact, the actuating contact comprising a cantilever, the fixed contact comprising a fixing panel and a resilient contact portion extending from the fixing panel for engaging with the cantilever of the actuating contact, the cantilever being downwardly moveable by the electrical card to engagingly push outwardly the resilient contact portion of the fixed contact;

wherein a cutout is defined in the sidewall and extends into the base portion, and the cantilever of the actuating contact and the resilient contact portion of the fixed contact extend into the cutout;

wherein the fixing panel of the fixed contact extends across the cutout of the sidewall of the housing;

wherein the fixing panel defines two notches in opposite sides of a free end thereof securely retaining the fixing contact in the sidewall of the housing;

wherein the cantilever of the actuating contact comprises an arcuate portion for contacting a bottom of an inserted electrical card, a linking piece extending from the arcuate portion, and an actuating piece extending from the linking piece for contactingly actuating the contact portion of the fixed contact;

wherein a curved portion is formed on a distal end of the contact portion of the fixed contact for contacting the actuating piece of the cantilever;

wherein the base portion of the housing defines a hollow portion, and wherein the actuating contact comprises a first tail portion extending into the hollow portion of the base portion of the housing;

wherein the fixed contact comprises a second tail portion extending into the hollow portion of the base portion of the housing.

* * * * *